US010632633B2

(12) United States Patent
Bloch et al.

(10) Patent No.: US 10,632,633 B2
(45) Date of Patent: Apr. 28, 2020

(54) UTILITY KNIFE

(71) Applicant: Outdoor Edge Cutlery Corporation, Denver, CO (US)

(72) Inventors: David R. Bloch, Morrison, CO (US); Houkun Liang, Guangdong (CN)

(73) Assignee: Outdoor Edge Cutlery Corporation, Denver, CO (US)

( * ) Notice: Subject to any disclaimer, the term of this patent is extended or adjusted under 35 U.S.C. 154(b) by 0 days.

(21) Appl. No.: 16/246,787

(22) Filed: Jan. 14, 2019

(65) Prior Publication Data

US 2019/0224861 A1 Jul. 25, 2019

Related U.S. Application Data

(60) Provisional application No. 62/619,904, filed on Jan. 21, 2018.

(51) Int. Cl.

| | |
|---|---|
| ***B26B 5/00*** | (2006.01) |
| ***B26B 11/00*** | (2006.01) |
| *B25G 1/08* | (2006.01) |

(52) U.S. Cl.

CPC ..... *B26B 5/003* (2013.01); *B26B 5/001* (2013.01); *B26B 11/00* (2013.01); *B25G 1/08* (2013.01); *B26B 11/008* (2013.01)

(58) Field of Classification Search

CPC ..... B26B 5/001; B26B 5/003; B26B 11/00; B26B 11/008; B25G 1/08

USPC ..... 30/160, 161, 162

See application file for complete search history.

(56) References Cited

U.S. PATENT DOCUMENTS

| | | | | |
|---|---|---|---|---|
| D230,823 | S | 3/1974 | Gluck | |
| 3,906,627 | A | 9/1975 | Manning | |
| 4,281,458 | A | 8/1981 | Okada | |
| D288,898 | S | 3/1987 | Osterhout | |
| 5,313,376 | A * | 5/1994 | McIntosh | F21V 33/0084 362/119 |
| D355,106 | S | 2/1995 | Yoshimoto | |
| 5,813,121 | A | 9/1998 | Gringer | |
| 6,161,290 | A * | 12/2000 | Takamasa | B26B 5/003 30/162 |
| D447,400 | S | 9/2001 | Okada | |
| D540,138 | S | 4/2007 | Kan | |
| 9,050,729 | B2 | 6/2015 | Hao | |
| 9,174,347 | B2 | 11/2015 | Hongquan | |
| D756,191 | S | 5/2016 | Horovitz | |

(Continued)

FOREIGN PATENT DOCUMENTS

| | | |
|---|---|---|
| AU | 2006202953 | 7/2006 |
| CA | 2481333 | 6/2005 |

(Continued)

*Primary Examiner* — Hwei-Siu C Payer

(74) *Attorney, Agent, or Firm* — Fisherbroyles, LLP; Craig W. Mueller

(57) ABSTRACT

A utility knife with a lockable blade is provided. The blade is selectively extended from a housing with a sliding mechanism. The blade is interconnected to a blade carrier that includes a portion configured to lock the blade in a deployed configuration. The blade carrier includes a deflectable portion that is selectively biased by the release button to unlock the blade from the deployed state. Spring force associated with a biasing member interconnected to the blade carrier draws the blade into the housing when the release button is dispersed.

20 Claims, 10 Drawing Sheets

(56) References Cited

U.S. PATENT DOCUMENTS

| | | | | |
|---|---|---|---|---|
| 9,579,808 | B2 | 2/2017 | Scimone | |
| 10,213,927 | B2 * | 2/2019 | Chiu | B26B 5/003 |
| 2004/0034937 | A1 * | 2/2004 | Ackeret | B25C 5/0214 7/160 |
| 2005/0283983 | A1 * | 12/2005 | Huang | B26B 5/001 30/162 |
| 2009/0193947 | A1 * | 8/2009 | Hancock | B25F 1/04 83/184 |
| 2010/0223793 | A1 * | 9/2010 | Hansen | B26B 1/046 30/162 |
| 2011/0283542 | A1 * | 11/2011 | Wu | B26B 5/003 30/162 |
| 2013/0025131 | A1 * | 1/2013 | Porret | G10K 5/00 30/123 |
| 2013/0298410 | A1 * | 11/2013 | Johnson | B26B 11/008 30/335 |
| 2014/0082850 | A1 * | 3/2014 | Stokes | H02G 1/005 7/108 |
| 2015/0013171 | A1 * | 1/2015 | Wu | B26B 5/001 30/162 |
| 2019/0224861 | A1 * | 7/2019 | Bloch | B26B 5/001 |

FOREIGN PATENT DOCUMENTS

| | | |
|---|---|---|
| CN | 201677334 | 12/2010 |
| CN | 102756384 | 10/2012 |
| CN | 102990680 | 3/2013 |
| CN | 102990681 | 3/2013 |
| FR | 2848138 | 6/2004 |
| FR | 2864463 | 7/2005 |
| FR | 2867716 | 9/2005 |
| FR | 2870152 | 11/2005 |
| WO | 2014000347 | 1/2014 |
| WO | 2014082447 | 6/2014 |

* cited by examiner

UTILITY KNIFE

This application also claims the benefit of U.S. Provisional Patent Application Ser. No. 62/619,904, filed Jan. 21, 2018, the entirety of which is incorporated by reference herein.

This application claims the benefit of application for Chinese Utility Model ZL201820097377.7, filed Jan. 19, 2018, now Chinese Utility Model CN207874277U, issued Sep. 18, 2018, the entirety of which is incorporated by reference herein.

FIELD OF THE INVENTION

Embodiments of the present invention are generally related to knives and, in particular, a utility knife with a selectively-extendable blade.

BACKGROUND OF THE INVENTION

Utility knives and box cutters often employ a mechanism for extending a blade from a housing and a release mechanism for retracting the blade into the housing. The housing usually comprises a hollow portion that accommodates a slidable blade carrier that secures a razor blade. The mechanism for extending the blade is commonly a sliding actuator positioned outside the housing and, thus, engageable with a user's thumb, wherein movement of the actuator either extends the blade from the housing or retracts the blade into the housing. Some utility knives are indexed, i.e., the blade may be moved between one of several locked positions, including fully retracted and fully extended. A common utility knife is shown in U.S. Pat. No. 4,621,425.

Another type of utility knife provides the ability to automatically retract the blade, wherein the blade is normally retracted in the housing and requires the user to apply pressure on the actuator to maintain the blade in a fully or partially deployed state. A spring interconnecting the housing and the blade carrier automatically retracts the blade upon actuator release. Spring tension may be such that when the blade is extended and inserted into the material being cut, e.g., cardboard, frictional influences between the blade and the material will maintain the blade in the extended position. Automatically retractable utility knives are described, for example, in U.S. Pat. Nos. 4,139,939 and 5,012,581.

It is a long-felt need to provide a utility knife with an automatically-retractable blade that can be selectively locked in an extended, deployed configuration. This disclosure describes a utility knife that employs a selectively-extendable and automatically-retractable blade that also includes additional tools and features.

SUMMARY OF THE INVENTION

It is one aspect of some embodiments of the present invention to provide a utility knife having a selectively-extendable and retractable blade. The blade, which may be a razor blade, is deployed when a user engages a sliding actuator interconnected to a blade housing. In a first position of use, the blade is concealed within the blade housing and the sliding actuator is located adjacent to a rearward end of the blade housing. In a second position of use, the sliding actuator is moved towards the forward end of the housing, which causes at least a portion of the blade to extend from the forward end. The blade may be locked in the second position of use. As one of ordinary skill in the art will appreciate, a utility knife of this type possesses enhanced safety as a user's hand and fingers are located away from the blade as it is deployed and retracted. Stated differently, gripping the housing and moving the sliding actuator with one's thumb keeps the user's hand and fingers engaged to the housing and away from the extending or extended blade.

It is another aspect of some embodiments of the present invention to provide an ergonomic blade housing. The blade housing of some embodiments of the present invention include a top surface with a plurality of gripping ridges. To further enhance comfort, the bottom surface may include an indentation that accommodates at least one finger. In one embodiment, the knife housing provides a forward indentation that acts as a finger choil that increases user safety by obstructing finger movement towards an extended blade. Further, the sliding actuator may have a contoured outer surface, which also may include a plurality of gripping ridges that facilitates thumb engagement.

As mentioned above, the extended blade may be locked. Accordingly, the sliding actuator of some embodiments of the present invention includes an operatively-interconnected button that, when depressed, releases a blade lock which allows the blade to retract into the housing. The release button may be conformed to completely or partially merge with the outer surface of the sliding actuator which allows the user to tactility appreciate when the blade release button has been depressed.

The housing of some embodiments of the present invention accommodate other features such as a belt or pocket clip that can also be used as a money clip. Further, the housing may include a hole configured to receive a cord, chain, ring, carabiner, or similar device. In some embodiments, the housing has portions molded to provide a flathead (i.e., slotted), Phillips, square, hex, Torx®, or other common screwdriver tip profile. Other features may be incorporated into the housing such as a compass, a USB computer memory storage device means, a flashlight, a strobe light, a bottle opener, a flint, a laser pointer, a whistle, a means for storing or directing mace or pepper spray, a pillbox, a medical ID, a battery, etc.

It is still yet another aspect of some embodiments of the present invention to provide a utility knife that employs a lockable blade carrier positioned within the housing. The blade carrier of one embodiment of the present invention is configured to accommodate blades of various sizes and shapes. For example, the blade carrier may be configured to accommodate trapezoid-shaped razor blades often called "utility razors." These blades commonly employ at least one notch at an upper surface and a sharp edge on an opposite end. The blade carrier may include at least one blade maintaining protrusion that engages the at least one notch. The blade is further maintained by at least one protrusion, or "foot," provided on the lower surface of the blade carrier. The blade carrier may also include a selectively-deflectable portion with an upper tab extending therefrom. The upper tab is interconnected to the release button, wherein the selectively-deflectable portion of the blade carrier is moved when the release button is depressed. Movement of the release button and interconnected tab unlocks the blade carrier and allows it to retract into the housing, which will be described in further detail below.

The blade carrier is interconnected to a spring, or similarly-functioning biasing device, that is also interconnected to a rearward point in the housing interior. For example, blade housing may include an inwardly-extending post configured to interconnect to one end of the spring, wherein the opposite end of the spring is interconnected to the blade carrier. In operation, the user elongates a spring by moving the sliding actuator towards the forward end of the utility knife, which extends the blade carrier and interconnected blade out of the blade housing. The blade carrier is locked relative to the housing when the blade is fully or partially extended from the forward end of the housing. The lock, thus, maintains the spring in a stretched state, wherein release of the blade carrier from the housing as described above will allow the spring to relax and draw the blade into the housing. Again, when the release button is pressed, a portion of the blade carrier of one embodiment of the present invention is flexed laterally relative to the longitudinal axis of the utility knife which releases the blade carrier from its lock so the spring can relax and draw the blade into the blade housing. Because the user's thumb is positioned adjacent to the sliding actuator and associated with the release button during this operation, the speed of blade retraction can be controlled by application of thumb pressure.

Although a coil spring is shown and described herein, those of ordinary skill in the art will appreciate other biasing devices can be used to draw the blade into the blade housing. For example, as razor blades are commonly constructed of ferromagnetic materials, a magnet, such as a rare earth magnet, may be employed at or near the rearward end of the housing. Releasing the blade carrier will cause the blade to succumb to the magnetic force and be drawn into the housing. Depending on the strength of the magnet/razor interaction, the user may have to tilt the forward end of the utility knife upwardly to allow gravity to initiate movement of the razor blade towards the magnet. The magnet maintains the stored blade in the rearward position. Alternatively, a resilient member not comprised of a coil spring may also be used. For example, a rubber band may be used that functions similar to the coil spring described above. Rubber bands would be easier to replace and less susceptible to oxidation.

Other embodiments provide multiple blade locks at the forward end and rearward end of the housing, wherein the blade release button would have to be pressed to deploy and retract the blade. The same or similar mechanism used to deflect a portion of the blade carrier could be used wherein locks would be provided adjacent to the forward and rearward ends of the blade housing. One of ordinary skill in the art will appreciate this aspect of the present invention may be employed by knives having multiple locking locations that allow the blade to be deployed incrementally to fit the user's needs. Furthermore, having a lock at the rearward end of the housing would require the user initiate blade deployment by depressing the primary release button, depressing a release button provided at the rearward end of the sliding actuator, or by overcoming some resistance to forward sliding actuator movement. This feature may be useful to prevent unintended deployment of the blade if the spring or alternative biasing member is omitted, damaged or broken.

Other features that could be employed with the utility knife of some embodiments of the present invention include utilizing a scraper or flint instead of a blade. Indeed, any application that calls for retractability, or where retractability would be beneficial, is contemplated by embodiments of the present invention. For example, the blade may be replaced with a magnifying glass, a mirror, a comb, etc. The housing described above may be made of metal for enhanced durability. But if some applications require reduced weight, plastic or composite may be used. Further, the sliding actuator may be also provided on either side of the housing to accommodate left-handed and right-handed users. The housing may also be configured to store one or more replacement blades.

It is one aspect of some embodiments of the present invention to provide a utility knife with a selectively-deployable blade, comprising: a housing with a forward end and a rearward end, the housing further comprising a first portion and a second portion, the first portion and the second portion being selectively interconnectable; a sliding actuation member operatively associated with at least one of the first portion and the second portion of the housing, the sliding actuation member having a first position of use adjacent to the rearward end and a second position of use adjacent to the forward end; a release button operatively interconnected to the sliding actuation member and configured to move therewith; a blade carrier positioned within the housing, the blade carrier adapted to accept and maintain a blade, the blade carrier having a selectively-deflectable portion with a protrusion extending therefrom that is interconnected to the release button, and the selectively-deflectable portion having a first position of use wherein a portion of the release button is configured to be captured by a locking portion associated with an inner surface of the housing, and a second position of use wherein the selectively-deflectable portion is flexed such that the portion of the release button is removed from the locking portion; a biasing member associated with at least one of the first portion and the second portion of the housing and the blade carrier, the biasing member configured to move the blade carrier toward the rearward end when the selectively-deflectable portion of the blade carrier is moved to the second position of use; wherein moving the sliding actuating member towards the forward end moves the carrier from a location adjacent to the rearward end to a forward end of the housing; and wherein movement of the release button moves the selectively-deflectable portion of the blade carrier from the first position of use to the second position of use.

It is yet another aspect of some embodiments of the present invention to provide a utility knife, comprising: a housing with a forward end and a rearward end; a blade carrier positioned within the housing, the blade carrier adapted to accept and maintain a blade, the blade carrier having a selectively-deflectable member that is configured to move from a first position of use wherein an upper portion of the blade carrier is captured by a lock associated with a forward end of the housing, and a second position of use wherein the selectively-deflectable member is moved from the lock; a biasing member associated with a rearward end of the housing, the biasing member configured to move the blade carrier toward the rearward end when the selectively-deflectable member of the blade carrier is moved to the second position of use; an actuation member operatively associated with the housing, the actuation member having a first position of use adjacent to the rearward end and a second position of use adjacent to the forward end, and wherein moving the actuation member moves the blade carrier from a location adjacent to the rearward end to a forward end of the housing; and a release button operatively interconnected to the actuation member and configured to move therewith, the release button interconnected to the upper portion of the blade carrier, wherein movement of the release button moves the selectively-deflectable member of the blade carrier from the first position of use to the second position of use.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the inventions given above and the detailed description of the drawings given below, serve to explain the principles of these inventions.

Figure 1:
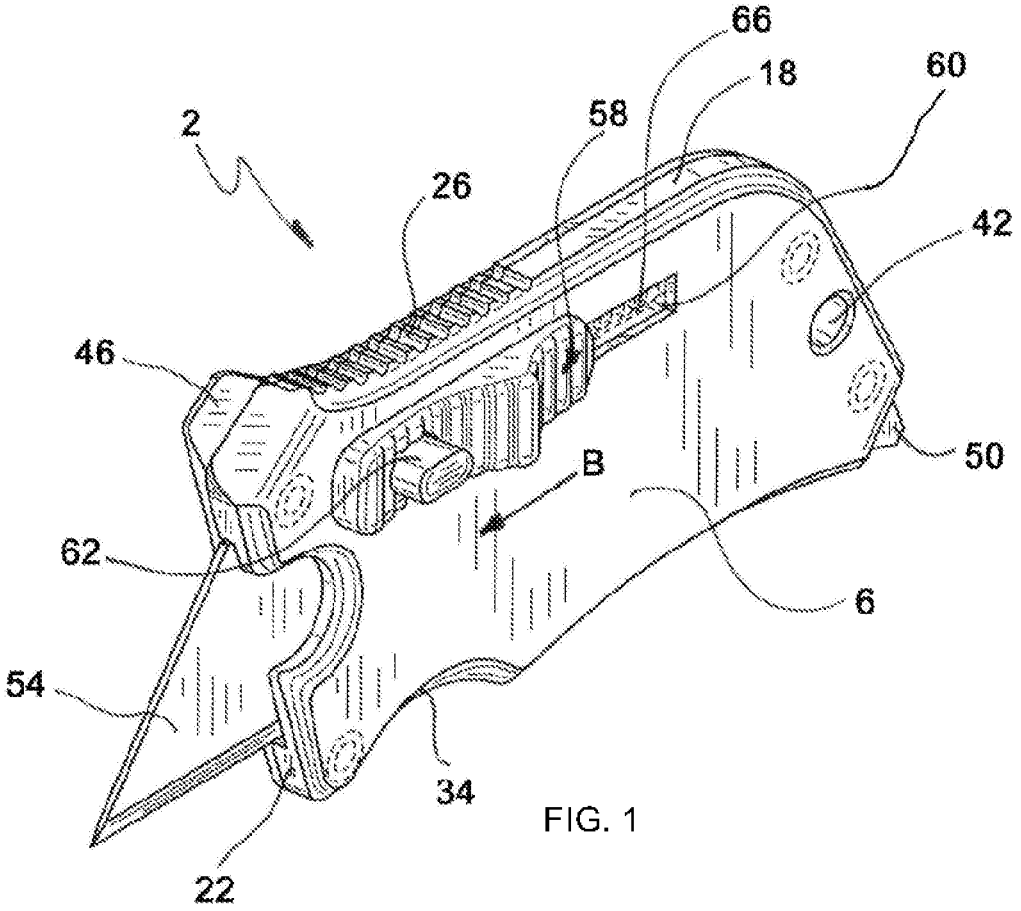
FIG. 1 is a front perspective view showing a utility knife of one embodiment of the present invention.
Figure 2:
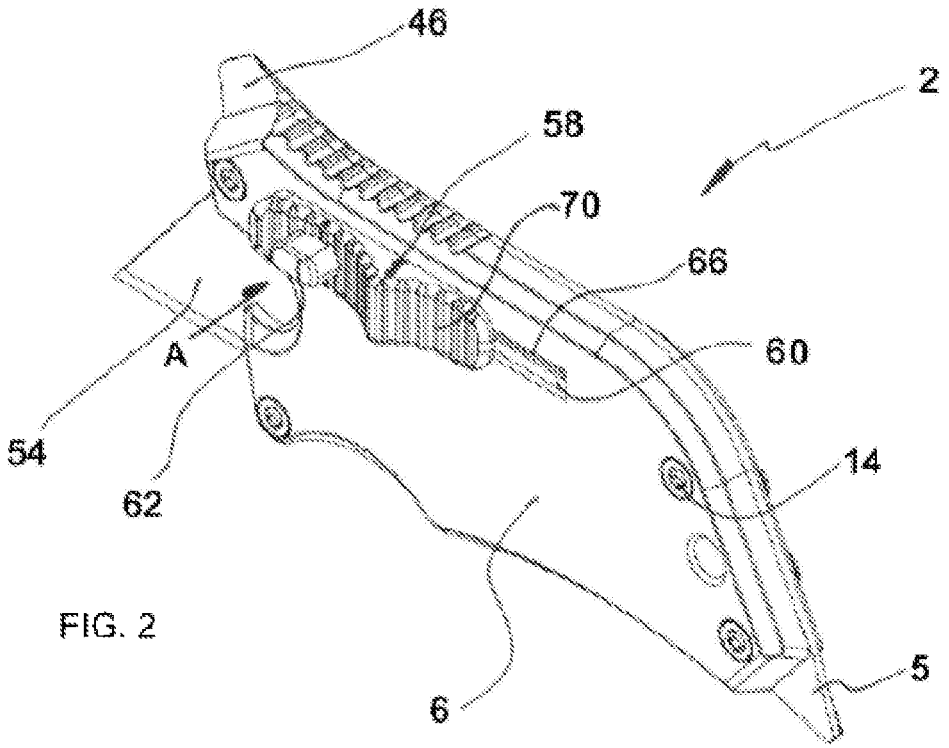
FIG. 2 is a rear perspective view of the utility knife shown in FIG. 1.
Figure 3:
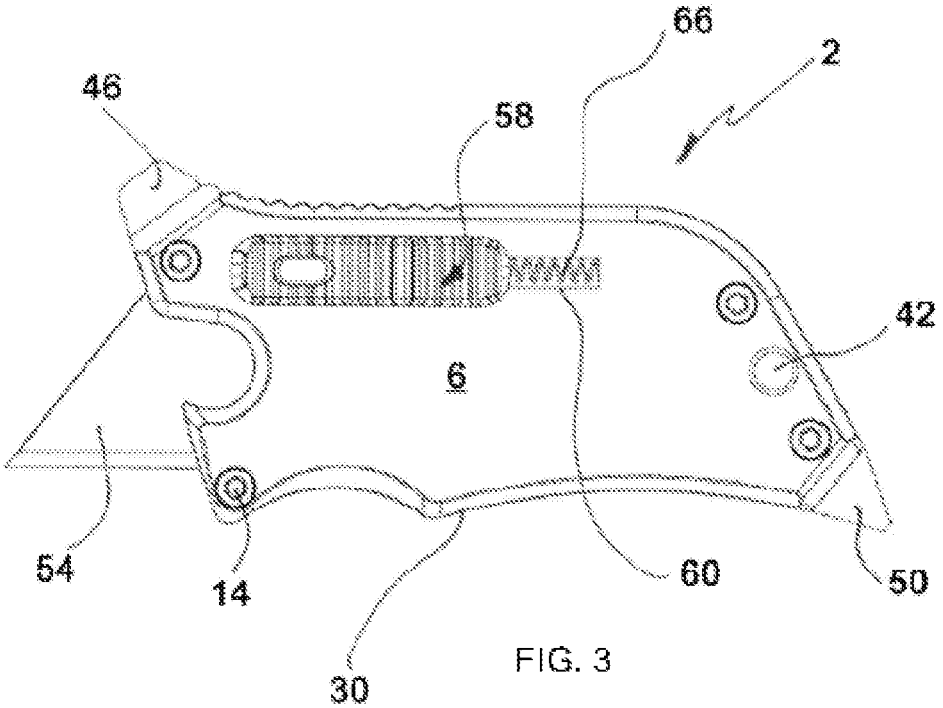
FIG. 3 is a front elevation view of the utility knife shown in FIG. 1.
Figure 4:
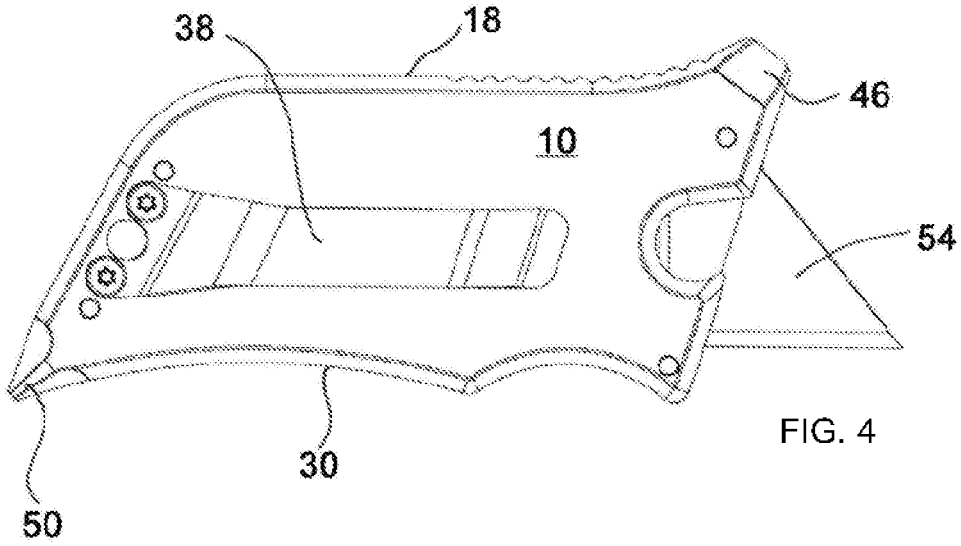
FIG. 4 is a rear elevation view of the utility knife shown in FIG. 1.
Figure 5:
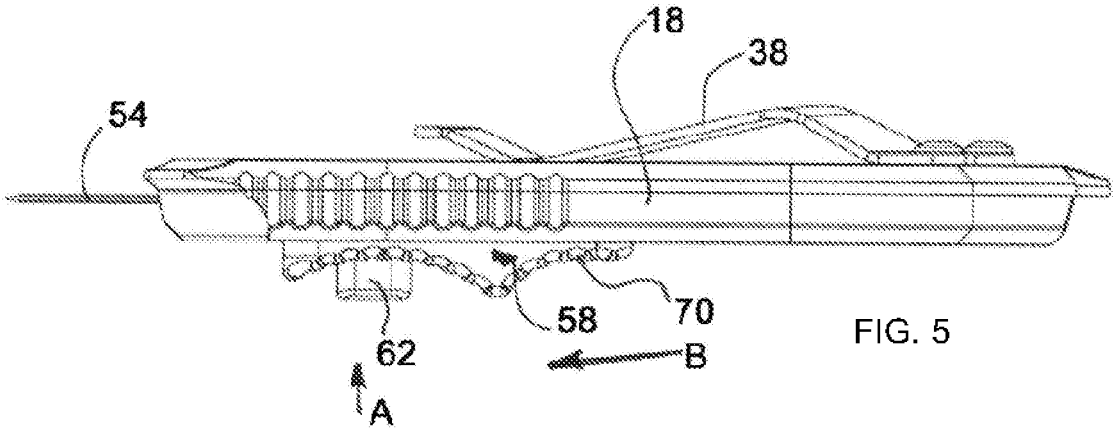
FIG. 5 is a top plan view of the utility knife shown in FIG. 1.
Figure 6:
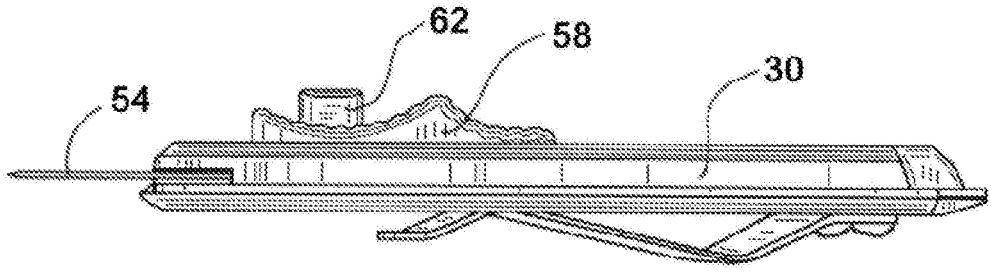
FIG. 6 is a bottom plan view of the utility knife shown in FIG. 1.
Figure 7:
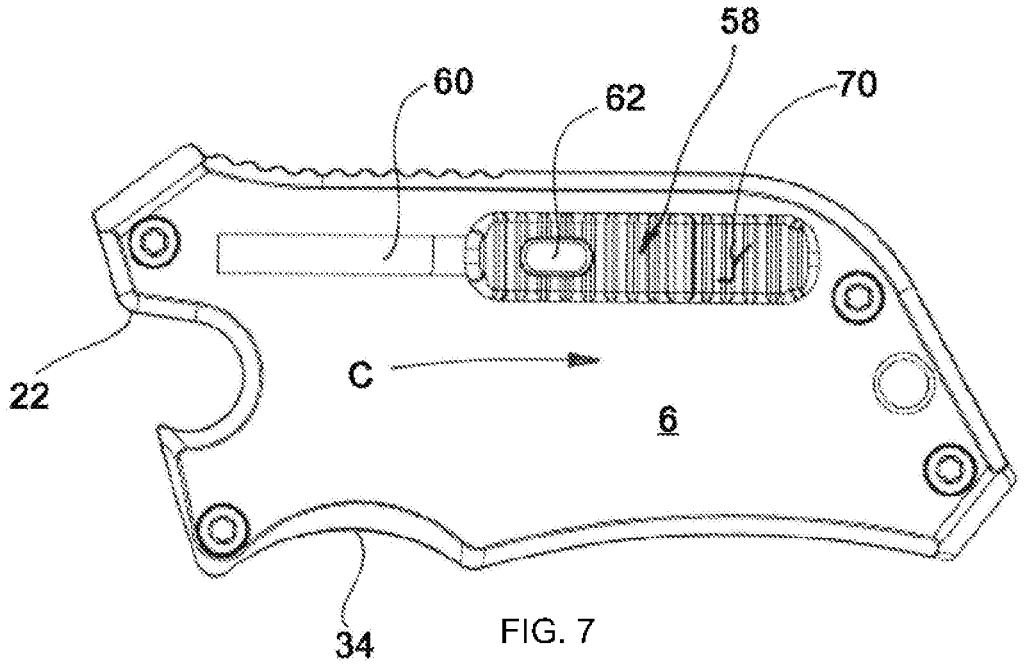
FIG. 7 is a front elevation view of the utility knife shown in FIG. 1, wherein a blade has been retracted and a rear housing portion has been removed.

To assist in the understanding of one embodiment of the present invention the following list of components and associated numbering found in the drawings is provided herein:

| # | Component |
|---|---|
| 2 | Utility knife |
| 6 | Front housing portion |
| 10 | Rear housing portion |
| 14 | Fasteners |
| 18 | Upper surface |
| 22 | Forward end |
| 26 | Thumb grip |
| 30 | Lower surface |
| 34 | Finger recess |
| 38 | Clip |
| 42 | Hole |
| 46 | Flathead screwdriver |
| 50 | Phillips head screwdriver |
| 54 | Blade |
| 58 | Sliding member |
| 60 | Slot |
| 62 | Release button |
| 66 | Biasing member |
| 70 | Rearward surface |
| 74 | Blade carrier |
| 78 | Posts |
| 80 | Inner surface |
| 82 | Front arm |
| 86 | Rear arm |
| 90 | Front stop |
| 94 | Rear stop |
| 98 | Forward section |
| 102 | Rear section |
| 106 | Deflectable portion |
| 110 | Front protrusion |
| 114 | Rear protrusion |
| 118 | Notch |
| 122 | Front foot |
| 126 | Rear foot |
| 130 | Lower portion |
| 134 | Finger |
| 138 | Tab |
| 142 | Inward face |
| 146 | Locking face |
| 150 | Inner wall |
| 154 | Upper groove |
| 158 | Lower groove |
| 162 | Lock recess |
| 166 | Locking wall |
| 170 | Rear face |
| 174 | Extension |
| 178 | Lug |
| 182 | Recess |
| 186 | Clip |
| 190 | Ledge |
| 194 | Slide groove |
| 198 | Aperture |
| 202 | Pocket |
| 206 | Lateral opening |
| 210 | Rear lock recess |
| 214 | Front face |
| 216 | Rear locking wall |
| 220 | Rear pocket |
| 224 | Thumb grip |
| 228 | Forefinger grip |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 1-11 show a utility knife 2 of one embodiment of the present invention that includes a housing comprising a front housing portion 6 selectively interconnected to a rear housing portion 10. The front housing portion 6 and the rear housing portion 10 are interconnected with the plurality of fasteners 14. The fasteners 14 can be removed to separate the front housing portion from the rear housing portion, thereby exposing the internal components of the utility knife 2. The housing of some embodiments of the present invention includes additional tools and user comfort-enhancing features. For example, an upper surface 18 of the housing may be curved towards the forward end 22 of utility knife 2, thereby providing an ergonomic surface that generally conforms to a user's thumb. The upper surface 18 may also include a thumb grip 26. A lower surface 30 of the utility knife 2 may also be configured to enhance user comfort and provide one or more finger recesses 34. Finger recesses 34 enhance grip and provide a choil that prevents unintended finger movement towards the forward and 22 of utility knife 2.

The housing of some embodiments of the present invention employs various components to increase functionality. For example, the housing may include a belt clip 38, which can also be used as a money clip. The belt clip 38 is configured to selectively engage the user's pocket or belt. The housing may also include a hole 42 configured to receive a keychain, a lanyard, a carabiner, etc., which provides additional storage options. Further, some embodiments of the present invention include tools integrated into the housing. For example, a flathead screwdriver 46 may be integrated into at least one of the forward or rear housing portions. Similarly, a Phillips head screwdriver 50 may also be integrated into the housing.

The housing accommodates a blade 54, which may be a trapezoidal-shaped razor blade, configured to move out of the housing by selective movement of the sliding member 58 that is operatively associated with a slot 60 provided in the front housing portion 6. Blade retraction is accomplished by actuating a release button 62 associated with the sliding member 58. More specifically, blade retraction is accomplished by way of a biasing member 66 that pulls the blade 54 into the housing once the blade release button 62 is depressed. Moving the sliding member 58 toward arrow B will move the blade 54 out of the housing, while depressing the release button 62 in a direction of arrow A will allow the sliding member 58 to move into the housing in the direction of arrow C. In operation, the user engages a rearward surface 70 of the sliding member 58 with their thumb and biases the sliding member 58 towards the forward end 22 of the utility knife 2, thereby extending the blade 54. To retract the blade 54, the user engages the release button 62. Pressing the release button 62 releases the blade 54 from a lock provided within the housing, which allows the biasing member to contract and pull the blade into the housing. Preferably, depression of the release button 42 will initiate full retraction of the blade (see FIG. 7), wherein no portion of the blade extends from the forward and 22 of utility knife 2.

Figure 8:
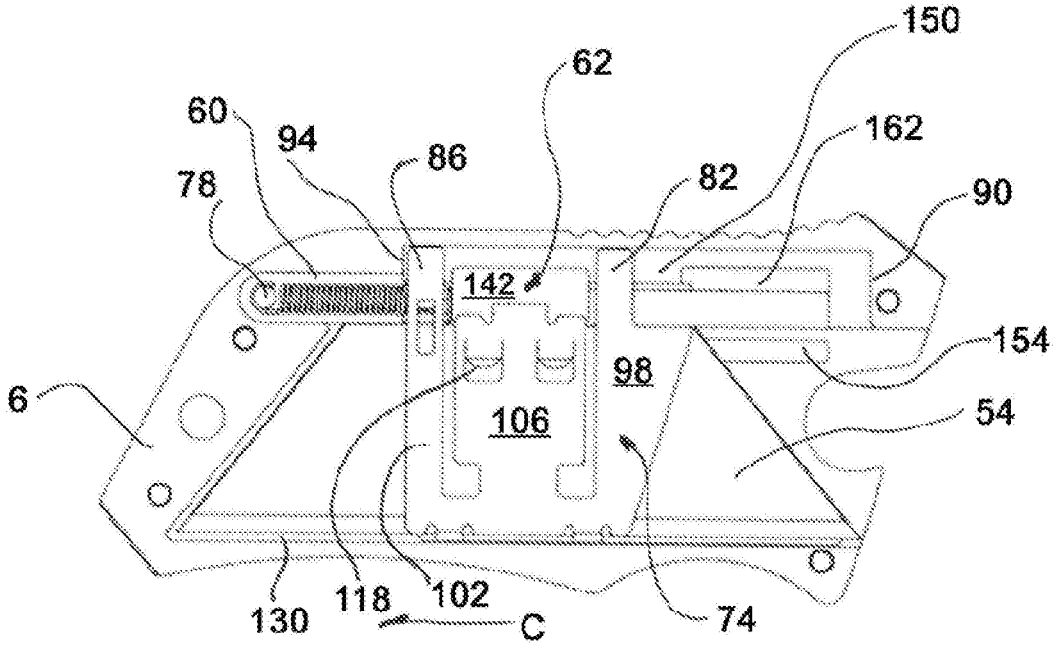
FIG. 8 is a rear elevation view of the utility knife shown in FIG. 1, wherein the rear housing portion has been removed.
Figure 9:
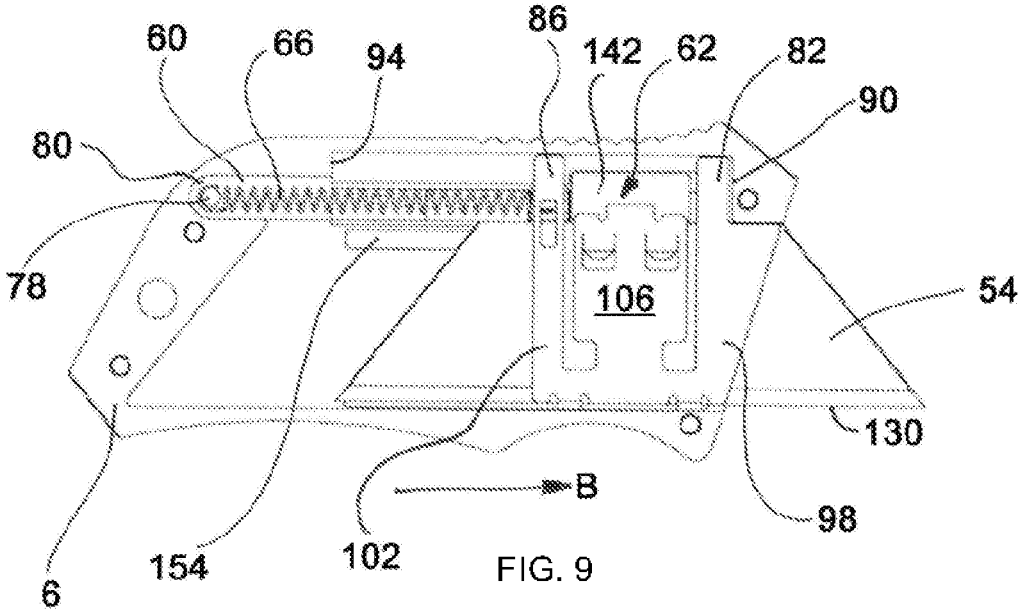
FIG. 9 is a rear elevation view similar to FIG. 8, wherein the blade is deployed.

FIGS. 8-11 illustrate how some embodiments of the present invention affect deployment and retraction of the blade 54. FIG. 8 shows the blade 54 retracted and stored within the housing. Here, the rear housing portion has been removed to expose internal components of one embodiment of the present invention. The blade 54 is secured to a blade carrier 74, which is also interconnected to the biasing member 66. The biasing member 66, which in one embodiment is a coiled spring, is interconnected on one end to a retaining post 78 extending from an inner surface 80 of the front housing 6. The opposite end of the biasing member 66 is associated with the blade carrier 74. The blade carrier 74 further comprises a front arm 82 and a rear arm 86 that selectively engage a front stop 90 and a rear stop 94 depending on the position of the blade carrier 74. The biasing member 66 can only pull the blade carrier 74 to a position defined by the interaction of the rear stop 94 with the rear arm 82. Similarly, the user cannot extend the blade 54 beyond a predetermined extent outside the housing because the front arm 82 will engaged the front stop 90, which is shown in FIG. 9. Again, depression of the release button 58 allows the blade carrier to succumb to the force provided by the biasing member 66, which pulls the blade carrier 74 and the attached blade 54 into the housing.

Figure 10:
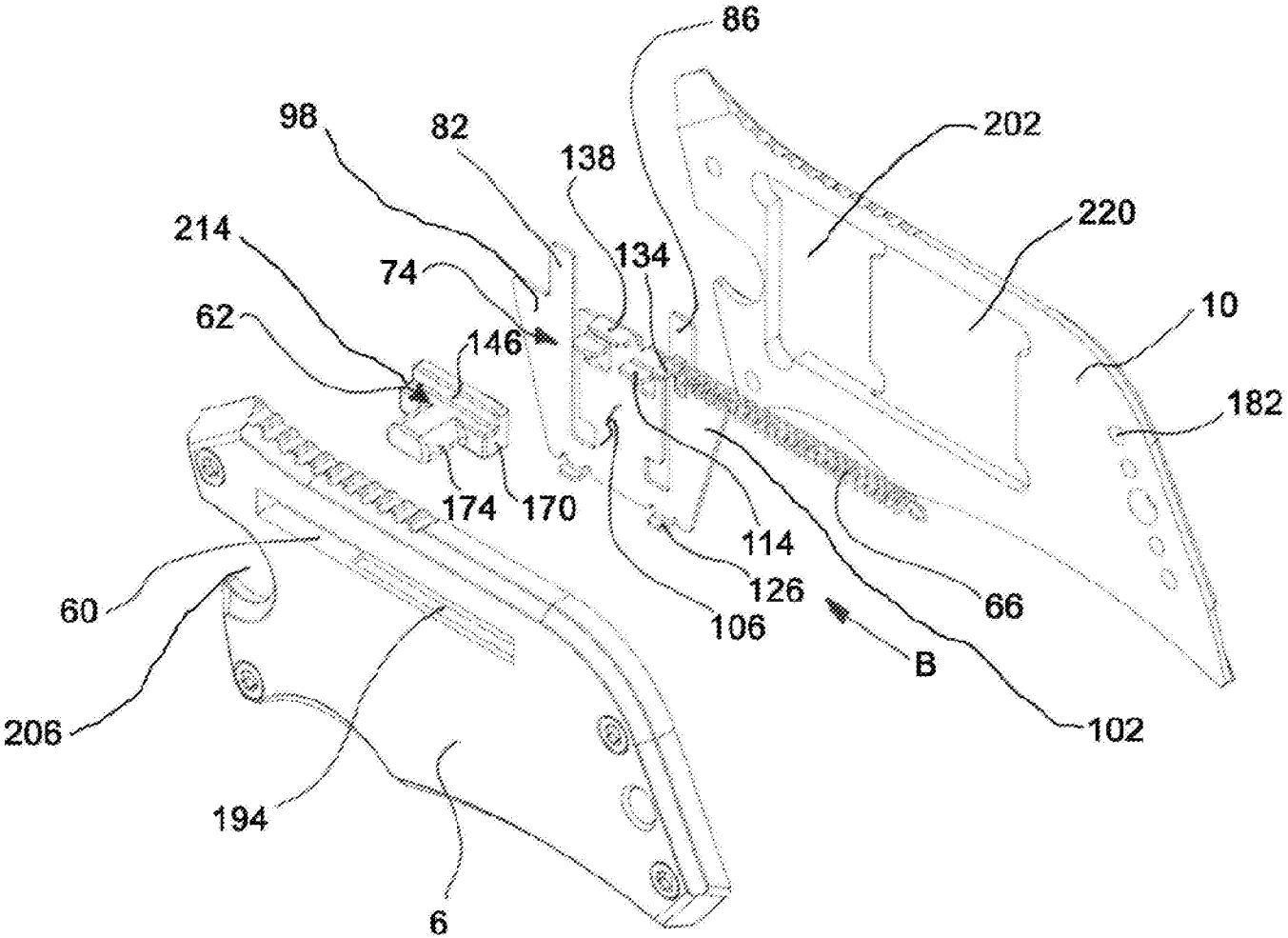
FIG. 10 is an exploded a rear perspective view of the utility knife shown in FIG. 1.
Figure 11:
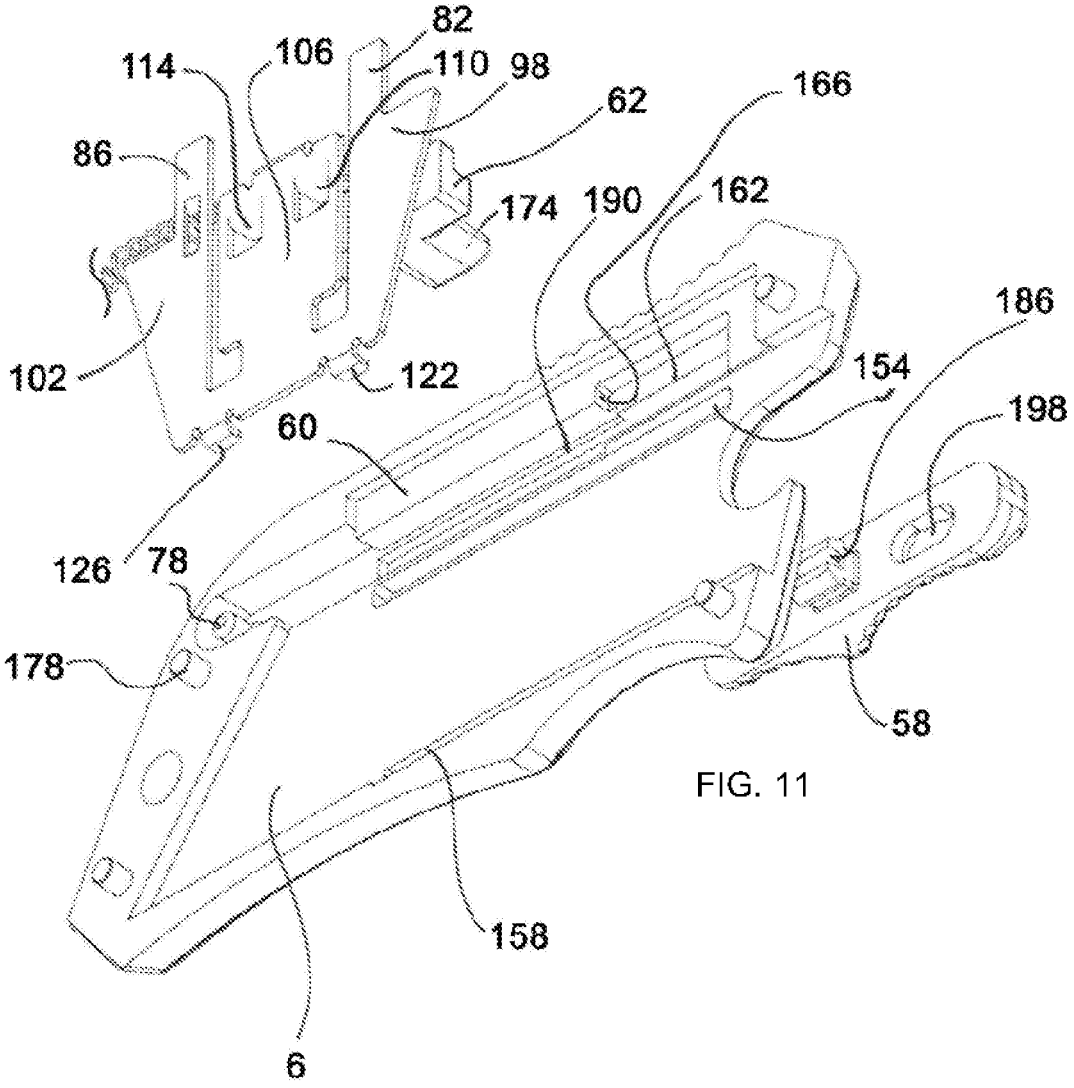
FIG. 11 is an exploded bottom perspective view of utility knife shown in FIG. 1, wherein a rear portion of the housing is not shown.
Figure 12:
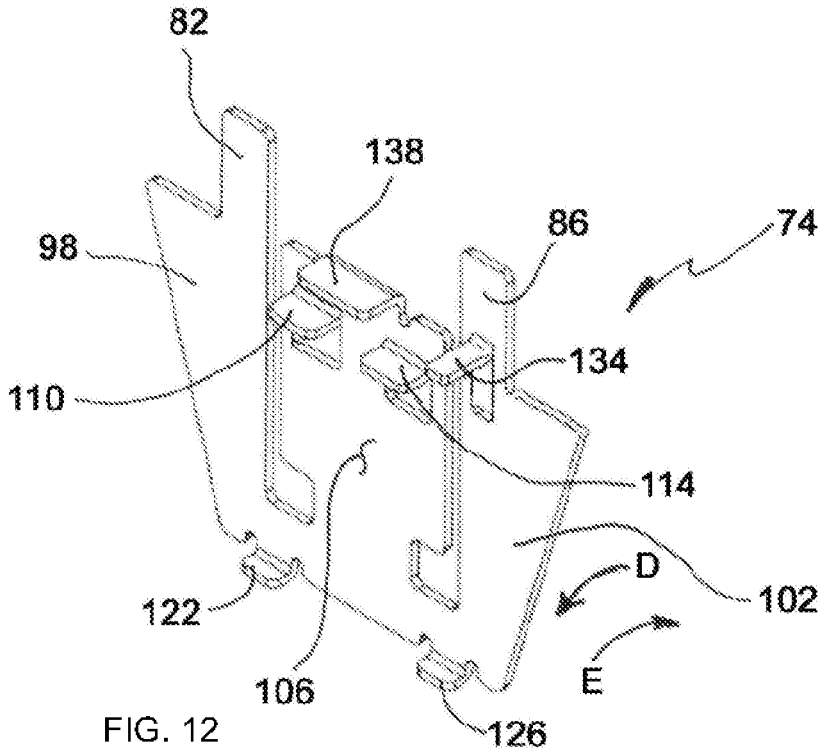
FIG. 12 is a perspective view of a blade carrier employed by some embodiments of the present invention.

FIGS. 10-12 show how the blade carrier 74 secures the blade 54 and how the blade carrier 74 is locked relative to the housing. The blade carrier 74 comprises a forward section 98 and a rear section 102 that include the front arm 82 and the rear arm 86, respectively. In addition, a deflectable portion 106 is positioned between the forward section 98 and the rearward section 102, which will be described in further detail below. The deflectable portion 106 includes a front protrusion 110 and a rear protrusion 114 configured to receive notches 118 commonly found on utility razor blades. In addition, the blade carrier 74 includes a front foot 122 and a rear foot 126 that contact the lower portion 130, i.e. the cutting edge, of the blade 54. Thus, the front protrusion 110, rear protrusion 114, front foot 122, and rear foot 126, secure the blade 54. The front section 98 and the rear section 102 of the blade carrier 74 increase the blade's effective lateral rigidity. The rear arm 86 also includes a finger 134 extending therefrom configured to receive one end of the biasing member 66.

Again, referring to FIGS. 8-12, the lock of some embodiments of the present invention comprises a combination of elements. As shown in FIG. 12, the blade carrier 74 includes an upper tab 138 that extends in the same direction as the front and rear protrusions and feet. The upper tab 138 is interconnected to an inward face 142 of the release button 62, which is shown in FIG. 8. In some embodiments of the present invention, the deflectable portion 106 of the blade carrier 74 is biased in a direction corresponding to arrow D and lateral from the outer surface of the front housing portion. The angled nature of the deflectable portion 106 urges a lock face 146 (see FIG. 10) of the release button 62 against an inner wall 150 of the front housing (see FIG. 8).

In operation, when the user moves the sliding member 58 within its slot 60 towards the forward end of the housing, the operatively-interconnected release button 62 and the interconnected blade carrier 74 will move within the blade housing. To increase stability of this motion, some embodiments of the present invention employ an upper groove 154 and a lower groove 158 configured to receive the forward/rear protrusions and bottom feet, respectively. As the blade carrier 74 moves forward, the biased deflectable portion 106 urges the locking face 146 against the inner wall 150. Eventually, forward motion of the sliding member 58 will locate the release button 62 over a lock recess 162 provided in the front housing 6 and the deflectable portion 106 will force the release button 62 into the lock recess 162. Here, the biasing member 66 is elongated, which generates tension that would normally retract the blade 54. The spring tension generated by locking the blade carrier is counteracted by interaction of a locking wall 166 associated with the lock recess 162 with a rear face 170 of the release button 62.

Actuating the release button 62 will remove the rear face 170 from the locking wall 166 and allow the biasing member 66 to retract the blade carrier 74.

More specifically, depression of an extension 174 protruding from the release button 62 will move the release button laterally into the housing. This pressure will move the deflectable portion 106 toward arrow E (see FIG. 12). The blade carrier 74 will succumb to the biasing member 66 and be drawn into the housing once the rear face 170 of the release button 62 is separated from the locking wall of the front housing 6. This configuration is extremely safe because the blade 54 is normally contained within the housing and held by the biasing member 66. Further, those of ordinary skill in the art will appreciate that the housing may include a plurality of lock recesses with associated locking walls to allow for incremental blade extension and locking. Such an embodiment, however, may require a blade extension button associated with the rearward surface 70 of the sliding member. Further, a lock recess may be employed towards the rear of the front housing portion, wherein user interaction with the blade extension button would be required before the sliding member can be moved in the direction of arrow B.

FIGS. 10 and 11 also show additional features of some embodiments of the present invention. Here, the front housing portion 6 includes a plurality of lugs 178 extending therefrom that are received in corresponding recesses 182, which helps the user to align the front housing portion to the rear housing portion and increases housing rigidity. Those of ordinary skill in the art will appreciate lugs 178 and recesses 182 may form a quick disconnect mechanism, wherein fasteners are not required.

FIG. 11 also shows how the sliding member 58 may include a clip 186 situated within the front housing 6, wherein an upper portion of the clip operatively engages a ledge 190 provided by the front housing 6. The lower portion of the clip 186 is operatively engaged within a slide groove 194 provided in the front housing 6 and associated with the slot 60. This configuration prevents movement of the sliding member 58 laterally from the front housing. An opening on the clip 186 may cooperate with the finger 134 to maintain the forward end of the spring on the blade carrier. The sliding member 58 also includes an aperture 198 configured to receive the extension 174 of the blade release button 62. When the sliding member 58 is moved along arrows B and C, interaction between aperture walls and the outer surface of the extension 174 will move the release button 62 and interconnected blade carrier 74 and, thus, affect movement of the blade into and out of the housing.

As shown in FIG. 10, the rear housing portion 10 may include a pocket 202 at its forward end. When the blade is extended, the deflectable portion 106 will be aligned with the pocket 202, which allows the deflectable portion 106 to move laterally when the release button 62 is depressed. As described above, depression of the release button 62 will unseat the rear face 170 from the lock recess provided in the front housing portion 6. Continued depression of the release button 62, however, will further position the deflectable portion 106 into the pocket 202, which will move the front protrusion 110 and rear protrusion 114 further away from the forward section 98 of the blade carrier. Depression of the release button 62 does not affect the lateral position of the blade because the lateral surface thereof is maintained by the forward section 98 and rearward section 102 of the blade carrier. As the deflectable portion 106 is moved laterally into the pocket 202, the front protrusion 110 and rear protrusion 114 are removed from the notches 118 (see FIG. 9) provided at the top surface of the blade. Accordingly, the user can pull the blade from the housing for reversal or replacement. Blade removal is achieved while the slider mechanism is positioned towards the forward end of the housing, which requires pressure be maintained on the sliding member to counteract the spring force that immediately pulls the blade and blade carrier towards the rear of the housing when the release button 62 is depressed.

The front housing portion 6 includes a lateral opening 206. When the sliding member is moved to the forward end of the front housing portion 6 with the blade removed, the forward section 98 will be visible. Replacing the blade is achieved by using the forward section 98 to guide a tip of the razor blade onto the blade carrier 74. Depression of the release button 62, while maintaining the forward position of the sliding member, will move the deflectable portion laterally into the pocket 202. This configuration allows the blade to be positioned on the feet of the blade carrier and allow the notches to be aligned with the front protrusion 110 and rear protrusion 114 as the blade is moved into the housing. As pressure is removed from the release button 62, the deflectable portion 106 will relax and the front protrusion 110 and the rear protrusion 114 will seat within their respective notches, thereby securing the blade to the blade carrier 74. The rear housing portion 10 may include an opening consistent with the lateral opening 206 of the front housing portion 6, wherein a bottle opener is formed at the forward end of the housing when the blade is retracted.

Figure 13:
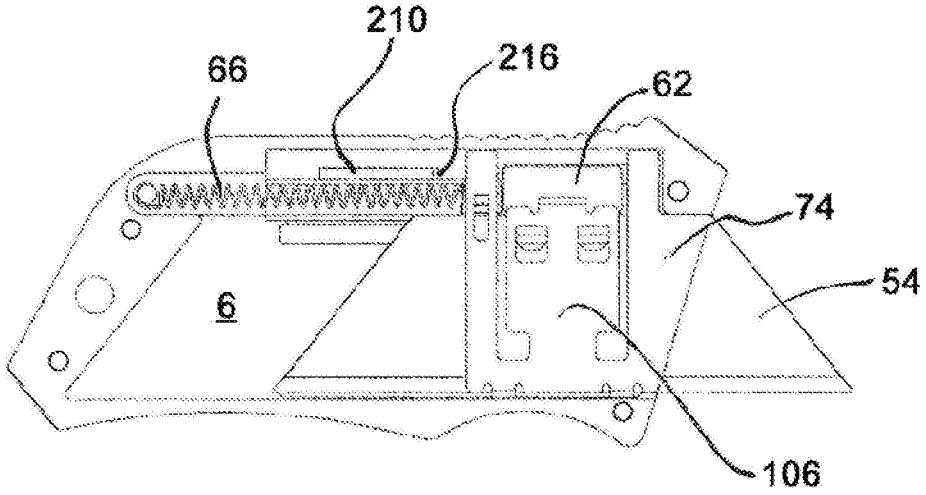
FIG. 13 is a rear elevation view of the front housing portion of another embodiment of the present invention that employs a rear lock recess.
Figure 14:
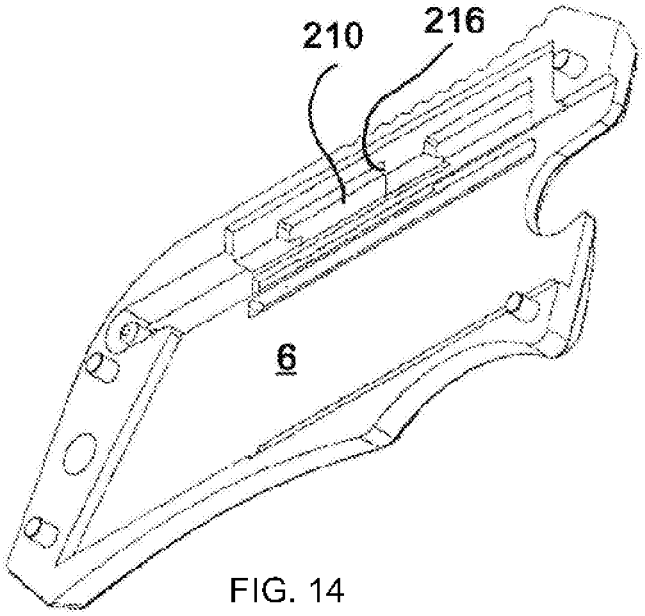
FIG. 14 is a bottom perspective view of FIG. 13.

FIGS. 13 and 14 show the front housing portion 6 of another embodiment of the present invention that includes a rear lock recess 210. FIG. 13 shows the blade 54 deployed and locked to the front housing portion 6 as described above. Again, depression of the release button 62 will allow the blade 54 to retract into the housing. In this embodiment, however, when the blade carrier 74 is retracted, the deflectable portion 106 of the blade carrier 74 biases the release button 62 into the rear lock recess 210. Interaction of a front face 214 (see FIG. 10) of the release button 62 and a rear locking wall 216 of the rear lock recess 210 prevents unintended movement of the blade carrier 74 towards the forward end of the housing. This feature is beneficial if the biasing member 66 becomes damaged, breaks, or is omitted. The rear locking wall 216 may comprise a ramp wherein movement of the sliding member towards the forward end of the housing will engage the front face 214 against the rear locking wall 216 and deflect the release button into the housing. Movement of the release button 62 subtly into the housing may be accommodated by a rear pocket 220 in the rear housing portion 10 (see FIG. 10) that receives the deflectable portion 106 of the blade carrier 74. Movement of the sliding member and operatively interconnected release button 62 will eventually cause the front face 214 to separate from the rear locking wall 216, which allows the sliding actuator to move the blade 54 out of the housing.

Figure 15:
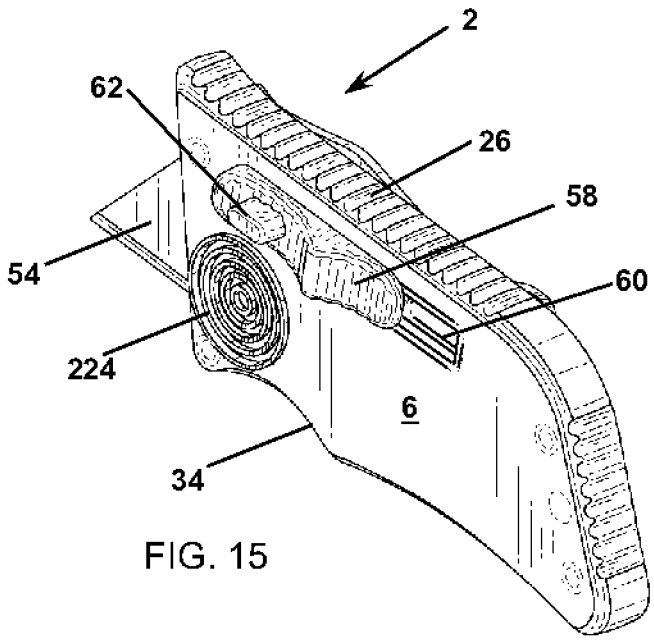
FIG. 15 is a front perspective of another embodiment of the present invention.
Figure 16:
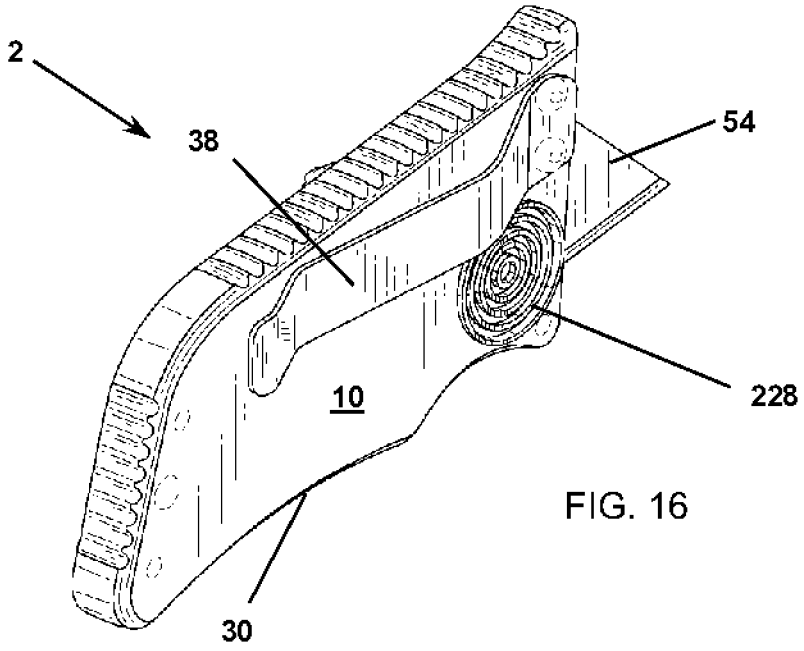
FIG. 16 is a rear perspective of the embodiment shown in FIG. 15.

FIGS. 15 and 16 shows a light weight version of some embodiments of the present invention. This embodiment omits some or the features described above, such as the screw drivers and bottle opener. The internal configuration and, thus, the mode of operation of this version is substantially similar to that of the embodiments described above.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A utility knife with a selectively-deployable blade, comprising:

a housing with a forward end and a rearward end, the housing further comprising a first housing portion and a second housing portion;

a sliding actuation member operatively associated with at least one of the first housing portion and the second housing portion, the sliding actuation member having a first position of use adjacent to the rearward end and a second position of use adjacent to the forward end;

a release button operatively interconnected to the sliding actuation member and configured to move therewith;

a blade carrier positioned within the housing, the blade carrier adapted to accept and maintain a blade, the blade carrier having a selectively-deflectable portion with a protrusion extending therefrom interconnected to the release button, wherein the selectively-deflectable portion has a first position of use wherein a portion of the release button is captured by a locking portion associated with an inner surface of the housing and a second position of use wherein the selectively-deflectable portion is flexed such that the portion of the release button is removed from the locking portion;

a biasing member associated with the blade carrier and at least one of the first housing portion and the second housing portion, the biasing member configured to move the blade carrier toward the rearward end when the selectively-deflectable portion of the blade carrier is moved to its second position of use;

wherein moving the sliding actuating member towards the forward end moves the blade carrier from a location adjacent to the rearward end toward the forward end of the housing; and wherein movement of the release button moves the selectively-deflectable portion of the blade carrier from its first position of use to its second position of use.

2. The utility knife of claim 1, wherein the inner surface of the housing comprises an inner surface of the first housing portion spaced from an inner surface of the second housing portion;

wherein the deflectable portion is biased towards the inner surface of the first housing portion;

wherein the first housing portion includes the locking portion comprised of a locking recess that extends into the inner surface of the first housing portion and selectively receives the portion of the release button, the locking recess including a locking face that selectively engages the portion of the release button to prevent movement of the blade carrier toward the rearward end of the housing.

3. The utility knife of claim 1, wherein the blade carrier is comprised of a foot adapted to support a cutting edge of the blade, wherein the blade carrier further comprises a protrusion extends laterally from the blade carrier and is adapted to engage a portion of the blade opposite the cutting edge.

4. The utility knife of claim 1, wherein the blade is selected from the group consisting of a rectangular razor blade, a trapezoidal razor blade, and a razor blade with a hooked portion.

5. The utility knife of claim 1, wherein the sliding actuation member has an arcuate outer surface adapted to receive a user's thumb.

6. The utility knife of claim 1, wherein the first housing portion and the second housing portion are selectively interconnectable and interconnected with a plurality of fasteners.

7. The utility knife of claim 1, wherein the biasing member is a spring.

8. The utility knife of claim 1, wherein the housing includes at least one of a file, a compass, a flashlight, a strobe light, a bottle opener, a flint, a laser pointer, a whistle, a pill container, a screwdriver, and a medical identification.

9. The utility knife of claim 1, wherein the housing comprises an upper surface and a lower surface, wherein a portion of the upper surface has a curved profile adjacent to the forward end.

10. The utility knife of claim 9, wherein the lower surface comprises a finger recess adjacent to the forward end.

11. A utility knife, comprising:

a housing with a forward end and a rearward end;

a blade carrier positioned within the housing, the blade carrier adapted to accept and maintain a blade, the blade carrier having a selectively-deflectable member configured to move from a first position of use wherein a release button interconnected to an upper portion of the blade carrier is captured by a lock associated with the forward end of the housing, and a second position of use wherein the release button is removed from the lock;

a biasing member associated with the rearward end of the housing and the blade carrier, the biasing member configured to move the blade carrier toward the rearward end when the selectively-deflectable member of the blade carrier is moved to the second position of use;

an actuation member operatively associated with the housing, the actuation member having a first position of use adjacent to the rearward end and a second position of use adjacent to the forward end, and wherein moving the actuation member moves the blade carrier from a location adjacent to the rearward end toward the forward end of the housing; and wherein the release button is operatively interconnected to the actuation member and configured to move therewith.

12. The utility knife of claim 11, wherein the lock is comprised of a recess provided in a first housing portion of the housing that selectively receives a first portion of the release button; and wherein the recess includes a locking face that selectively engages the first portion of the release button to prevent movement of the blade carrier toward the rearward end of the housing.

13. The utility knife of claim 11, wherein the blade carrier is comprised of a foot adapted to support an edge of the blade, and wherein the selectively-deflectable member comprises a laterally-extending protrusion adapted to engage a portion of the blade opposite the edge.

14. The utility knife of claim 11, wherein the blade is selected from the group consisting of a rectangular razor blade, a trapezoidal razor blade, and a razor blade with a hooked portion.

15. The utility knife of claim 11, wherein the actuation member has an arcuate outer surface adapted to receive a user's thumb.

16. The utility knife of claim 11, wherein the biasing member is a spring.

17. The utility knife of claim 11, wherein the biasing member is a rubber band.

18. The utility knife of claim 11, wherein the housing includes at least one of a file, a compass, a flashlight, a strobe light, a bottle opener, a flint, a laser pointer, a whistle, a pill container, a screwdriver, and a medical identification.

19. The utility knife of claim 11, wherein the housing comprises an upper surface and a lower surface, wherein a portion of the upper surface has a curved profile adjacent to the forward end.

20. The utility knife of claim 19, wherein the lower surface comprises a finger recess adjacent to the forward end.

* * * * *